US009199283B2

(12) United States Patent
Kojima et al.

(10) Patent No.: US 9,199,283 B2
(45) Date of Patent: Dec. 1, 2015

(54) SEPARATION APPARATUS AND SEPARATION METHOD

(75) Inventors: Tamao Kojima, Osaka (JP); Masatoshi Miyasaka, Osaka (JP); Hideshi Ueda, Osaka (JP); Shinji Yoshino, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 262 days.

(21) Appl. No.: 13/809,458

(22) PCT Filed: Sep. 12, 2012

(86) PCT No.: PCT/JP2012/005781
§ 371 (c)(1),
(2), (4) Date: Jan. 10, 2013

(87) PCT Pub. No.: WO2013/088609
PCT Pub. Date: Jun. 20, 2013

(65) Prior Publication Data

US 2014/0197078 A1 Jul. 17, 2014

(30) Foreign Application Priority Data

Dec. 15, 2011 (JP) ..... 2011-274769

(51) Int. Cl.
*B07C 5/00* (2006.01)
*B07C 5/36* (2006.01)

(52) U.S. Cl.
CPC . *B07C 5/00* (2013.01); *B07C 5/368* (2013.01); *B07C 2501/0018* (2013.01)

(58) Field of Classification Search
CPC ..... B07C 5/363; B07C 5/365; B07C 5/367; B07C 5/368; B07C 5/342
USPC ..... 209/44.2, 576–589, 638, 639
See application file for complete search history.

(56) References Cited

U.S. PATENT DOCUMENTS 4,848,590 A 7/1989 Kelly
6,003,681 A 12/1999 Wilbur et al.
(Continued)

FOREIGN PATENT DOCUMENTS

CA 1 242 260 9/1988
JP 2002-263587 9/2002
(Continued)

OTHER PUBLICATIONS

Office Action and Search Report mailed Dec. 13, 2013 in corresponding Chinese patent application No. 201280002205.2 with English translation of Search Report.
(Continued)

*Primary Examiner* — Joseph C Rodriguez
*Assistant Examiner* — Kalyanavenkateshware Kumar
(74) *Attorney, Agent, or Firm* — Wenderoth, Lind & Ponack, L.L.P.

(57) ABSTRACT

A separation apparatus includes: a conveyor that conveys a group of pieces; a material distinguishing unit that distinguishes between first pieces and second pieces that are placed on the conveyor, according to material; a blower that generates airflow supplied from a middle of the conveyor toward a conveying end along a conveying surface; a first separation unit that blows off the first pieces thrown forward from the conveying end, based on a differentiation result obtained by the material distinguishing unit; a second separation unit that blows off the second pieces toward a different place; and a current plate provided below the group of pieces thrown forward and protruding from the conveyor.

8 Claims, 9 Drawing Sheets

(56) References Cited

U.S. PATENT DOCUMENTS

| | | | | |
|---|---|---|---|---|
| 6,265,683 | B1 * | 7/2001 | Flottmann et al. | 209/576 |
| 6,541,725 | B2 * | 4/2003 | Pearson | 209/590 |
| 6,545,240 | B2 | 4/2003 | Kumar | |
| 6,727,452 | B2 * | 4/2004 | Schrader | 209/576 |
| 6,795,179 | B2 | 9/2004 | Kumar | |
| 7,326,871 | B2 | 2/2008 | Kenny et al. | |
| 7,816,616 | B2 | 10/2010 | Kenny et al. | |
| 8,286,800 | B2 * | 10/2012 | Kojima et al. | 209/631 |
| 2003/0034281 | A1 | 2/2003 | Kumar | |
| 2003/0132142 | A1 | 7/2003 | Kumar | |
| 2004/0245156 | A1 | 12/2004 | Gaddis et al. | |
| 2006/0081510 | A1 | 4/2006 | Kenny et al. | |
| 2007/0158245 | A1 | 7/2007 | Kenny et al. | |

FOREIGN PATENT DOCUMENTS

| | | |
|---|---|---|
| JP | 2003-275690 | 9/2003 |
| JP | 2003-275692 | 9/2003 |
| JP | 2005-28285 | 2/2005 |
| JP | 2007-29923 | 2/2007 |
| JP | 2008-156065 | 7/2008 |
| JP | 2010-279921 | 12/2010 |
| JP | 2011-173049 | 9/2011 |
| WO | 97/46328 | 12/1997 |

OTHER PUBLICATIONS

Extended European Search Report mailed Aug. 7, 2015 in corresponding European patent application No. 12820845.1.

* cited by examiner

End position of current plate = (A/R) ∗100

FIG. 10

| | PP (First nozzle) | ABS (Second nozzle) |
|---|---|---|
| Present invention | 90 % | 88 % |
| Example of related art | 88 % | 53 % |

SEPARATION APPARATUS AND SEPARATION METHOD

BACKGROUND OF THE INVENTION

1. Technical Field

The present invention relates to a separation technique for separating pieces made of a specific material from a group of pieces that is a separation subject and, more particularly, the present invention relates to a separation technique for separating pieces made of a specific class of resins from a separation subject obtained by crushing used home appliances.

2. Description of the Related Art

Economic activities in recent years represented by mass production, mass consumption, and mass disposal have been causing global environmental problems such as global warming and depletion of resources. Under such circumstance, attention has been paid to the recycling of home appliances, and recycling of used home appliances such as air conditioners, televisions, refrigerators/freezers, and washing machines has become mandatory, in an effort to build a recycling society.

Conventionally, unneeded home appliances have been recycled by crushing them into small pieces in home appliance-recycling plants and separating the small pieces by material, using magnetism, wind, oscillation, etc. In particular, the use of a specific-gravity separation apparatus or a magnetism separation apparatus allows small pieces made of metal to be separated by metal species such as iron, copper, and aluminum in very pure form. This achieves a high recycling rate.

On the other hand, as to resin materials, small pieces made of polypropylene (hereinafter referred to as PP) that has a low specific gravity are separated from a component having a high specific gravity through specific separation using water, and thus are recovered with a relatively high degree of purity. This specific gravity separation using water, however, has major problems that; an enormous amount of wastewater is produced and that; small pieces made of polystyrene (hereinafter denoted as PS) and small pieces made of acrylonitrile-butadiene-styrene (hereinafter denoted as ABS), which have similar specific gravities, are not separated from each other.

Japanese Unexamined Patent Application Publication No. 2002-263587 suggests a separation method in view of the above problem related to recycling of resin materials.

The technique disclosed by JP 2002-263587 uses a material distinguishing unit to detect a material, thereby enabling separation of resin materials which are inseparable by specific gravity separation.

To be specific, materials of separation subjects conveyed on a conveyor belt are distinguished for each group of small pieces with the material distinguishing unit, and in order to separate the distinguished resin items made of a specific resin material from the trajectories of the separation subjects thrown forward from a conveying end of the conveyor belt. In the separation method, pulse air is discharged from nozzles provided above or below the trajectories of the separation subjects so as to blow off small pieces of a specific material and separate from a group of the separation subjects.

The conventional method for separating separation subjects that is recited in JP 2002-263587 will be further described in detail with reference to drawings.

FIGS. 7*a* to 7*c* and 8 illustrate an example of a conventional method for separating separation subjects. FIGS. 7*a* to 7*c* are side views of a process for separating pieces 2A made of any specific material from small pieces 2A, 2B, 2C, and 2D conveyed by a conveyor 1. FIG. 8 is a plan view of the process.

FIG. 7*a* illustrates small pieces 2A, 2B, 2C and 2D as separation subjects conveyed by the conveyor 1, and the small pieces 2A is made of any specific material. The numerical reference 3 in FIG. 7*a* indicates a material distinguishing unit. The numerical reference 4 in FIG. 7*a* indicates a conveying end of the conveyor 1, from which the small pieces 2A, 2B, 2C, and 2D are thrown forward. The numerical reference 5 in FIG. 7*a* indicates a nozzle group provided in the width direction of the conveyor 1 to separate the small pieces 2A of a specific material from the trajectories of the small pieces 2A, 2B, 2C, and 2D that have been thrown forward from the conveying end 4. The numerical reference 8 in FIG. 7A indicates a separation plate for separating the small pieces 2A of the specific material that has been separated from the trajectories of the small pieces 2A, 2B, 2C, and 2D. It should be noted that FIG. 7*a* is a side view and FIG. 8 is a plan view of the same scene as the scene shown in FIG. 7*a*.

FIG. 7*b* illustrates that the material distinguishing unit 3 distinguishes the materials and shapes of the separation subjects 2A, 2B, 2C, and 2D when the separation subjects are passing under the material distinguishing unit 3.

FIG. 7*c* illustrates that the small pieces 2A, 2B, 2C, and 2D distinguished by the material distinguishing unit 3 are thrown forward from the conveying end 4. Moreover, when the small pieces 2A of any specific material pass under a group of nozzles 5, pulse air is discharged only from a nozzle of the group of nozzles 5, corresponding to the small pieces 2A so as to blow off the small pieces 2A of any specific material and separate from the small pieces of other materials. Moreover, representative trajectories of the small pieces 2A, 2B, 2C, and 2D thrown forward from the conveying end 4 of the conveyor 1 are represented by a solid line, a broken line, and a dashed-dotted line.

Thus, according to the conventional separation method recited in JP 2002-263587, a material distinguishing unit and pulse air can separate items made of a specific material from a group of the separation subjects. Therefore, it is possible to separate PS and ABS which have similar specific gravities.

It should be noted that in the conventional separation method recited in JP 2002-263587, since one specific material is separated by separation processing at one time, separation processing is performed several times to separate two or more specific materials from a group of the separation subjects.

SUMMARY OF THE INVENTION

1. Technical Problem

To improve separation efficiency using the conventional separation method recited in JP 2002-263587, separating pieces of two or more specific materials at one time can be considered. To separate pieces of two or more specific materials by separation processing at one time, it is necessary to provide two independent groups of air nozzles along the trajectories of pieces to be separated, and separate pieces from the trajectories of the pieces to be separated, according to material, by pulse air discharged from the groups of nozzles.

The following describes, in detail, a method for concurrently separating pieces of two or more specific materials by separation processing at one time, using the conventional method recited in JP 2002-263587, with reference to the drawings.

FIGS. 9*a* to 9*c* illustrate an embodiment of a separation method for concurrently separating pieces of two or more specific materials by separation processing at one time. FIGS.

9*a* to 9*c* illustrate a process for separating pieces 2A of a predetermined material and pieces 2B of a predetermined material, from pieces 2A, 2B, 2C, and 2D that are separation subjects and are conveyed by a conveyor 1.

FIG. 9*a* illustrates the pieces 2A, 2B, 2C, and 2D that are separation subjects and are conveyed by the conveyor 1. In FIG. 9*a*, the pieces 2A and the pieces 2B are any specific materials, respectively. The material distinguishing unit 3 and the conveying end 4 of the conveyor 1, from which pieces 2A, 2B, 2C, and 2D to be separated are thrown forward, are the same as those shown in FIGS. 7*a* to 7*c*. The numerical references 5A and 5B in FIG. 9*a* indicate groups of nozzles that are provided in the width direction of the conveyor 1, to separate the pieces 2A and 2B of specific materials, from the trajectories of the pieces 2A, 2B, 2C, and 2D thrown forward from the conveying end 4. The numerical references 8A and 8B in FIG. 9*a* indicate separation plates for separating the pieces 2A and 2B of specific materials that have been separated from the trajectories of the pieces 2A, 2B, 2C, and 2D to be separated.

FIG. 9*b* illustrates the pieces 2A, 2B, 2C, and 2D to be separated are passing under the material distinguishing unit 3, and materials and shapes are distinguished by the material distinguishing unit 3.

FIG. 9*c* illustrates the pieces 2A, 2B, 2C, and 2D to be separated, which have been distinguished by the material distinguishing unit 3 are being thrown forward from the conveying end 4 of the conveyor 1. Moreover, when the pieces 2A and 2B of any specific materials are passing under the groups of nozzles 5A and 5B, air is discharged in a pulse-like manner. Thus, the pieces 2A and 2B of any specific materials are separated from the trajectories of the pieces 2A, 2B, 2C, and 2D to be separated. It should be noted that the representative trajectories of the pieces 2A, 2B, 2C, and 2D that are separation subjects and have been thrown forward from the conveying end 4 of the conveyor 1 are represented by a solid line, a broken line, and a dashed-dotted line.

The difference in shape and specific gravity causes variation in trajectories of the pieces 2A, 2B, 2C, and 2D that are separation subjects and have been thrown forward from the conveying end 4 of the conveyor 1. Moreover, greater variation can be seen as pieces move away from the conveying end 4 of the conveyor 1. For example, as materials with a small apparent specific gravity such as urethane foam have larger drag force, the trajectory of such a material is represented by the dashed-dotted line shown in FIG. 9*c*, which means that pieces tend to drop near the conveyor 1. Moreover, materials such as sheet resin materials having a small thickness and a large area may ascend by lift force and the trajectory of such a material may be represented by the dotted line in FIG. 9*c*. Thus, the separation in a place distant from the conveying end 4 of the conveyor 1 decreases the accuracy due to variation in trajectories.

Therefore, reducing variation in trajectories of pieces to be separated is a problem in order to concurrently separate two or more specific materials by separation processing at one time with a high degree of accuracy.

The present invention has been made in view of the above problems, and a major object of the present invention is to provide a separation apparatus and a separation method for separating separation subjects with high separation efficiency and with high degree of accuracy.

2. Solution to the Problem

To achieve the above problem, in a separation method of pieces to be separated, pieces (separation subject) which are conveyed by the conveyor are distinguished on a conveyor, and the distinguished pieces of at least two materials are independently separated from a trajectory of the separation subject that has been thrown forward from the conveying end of the conveyor, by pulse air discharged from at least two groups of nozzles which are independently provided along the trajectory of the separation subject. In the separation method, airflow is supplied toward the conveying end of the conveyor, i.e., in a direction that is the same as the direction in which the conveyor is transferred, along a conveying surface, a plate is provided along the trajectory of the separation subject, the starting end of the plate is provided beside the conveying surface and the plate protrudes along the conveying surface, and the upper surface of the plate is provided below the trajectory of the separation subject so that the separation subject drops without touching the plate.

Moreover, in the separation method of pieces to be separated, the velocity of airflow at the conveying end of the conveyor ranges from ½ to 3 times the speed of the conveyor.

Moreover, in the separation method of pieces to be separated, the vertical thickness of the airflow is greater than the height of pieces that are separation subjects and are conveyed by the conveyor.

Moreover, in the separation method of pieces to be separated, the terminal end of the plate provided along the trajectories of pieces to be separated is located vertically upward from a point obtained by moving the point from the center of the head pulley horizontally and in the direction in which the conveyor is transferred, and the distance between the point moved in the direction in which the conveyor is transferred and the center of head pulley is greater than or equal to the length of 80% of a head-pulley radius.

3. Advantageous Effects of the Invention

In a separation method according to the present invention, pieces (separation subject) which are conveyed by the conveyor are distinguished on a conveyor, and the distinguished pieces of at least two materials are independently separated from a trajectory of the separation subject that has been thrown forward from the conveying end of the conveyor, by pulse air discharged from at least two groups of nozzles which are independently provided along the trajectory of the separation subject. In the separation method, airflow is supplied toward the conveying end of the conveyor, i.e., in a direction that is the same as the direction in which the conveyor is transferred, along a conveying surface, a plate is provided along the trajectory of the separation subject, the starting end of the plate is provided beside the conveying surface, and the upper surface of the plate is provided below the trajectory of the separation subject so that the separation subject drops without touching the plate. This configuration can achieve a separation method of pieces to be separated with high yield and with high degree of separation accuracy, which has been difficult to achieve.

BRIEF DESCRIPTION OF THE DRAWINGS

FIG. 10 illustrates the recovery yield of PP and ABS both in the embodiment of the present invention and an example of the related art.

DETAILED DESCRIPTION OF THE INVENTION

The following describes an embodiment of a separation apparatus and a separation method according to the present invention, with reference to drawings. It should be noted that a separation apparatus and a separation method according to the present invention in the following embodiment is provided for illustrative purposes only. Therefore, the scope of the present invention is defined by the claim wording with the following embodiment as a reference, and the present invention is not limited to only the following embodiment.

Figure 1A:
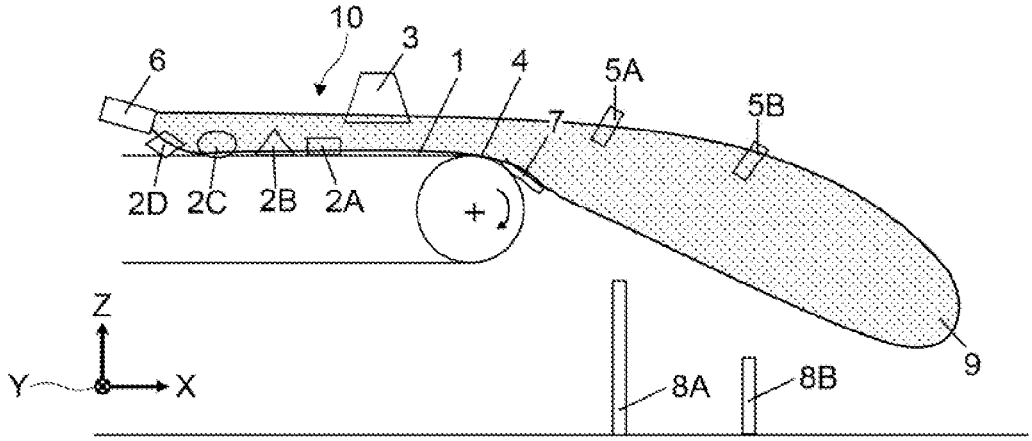
FIG. 1*a* is a side view illustrating a separation apparatus.
Figure 1B:
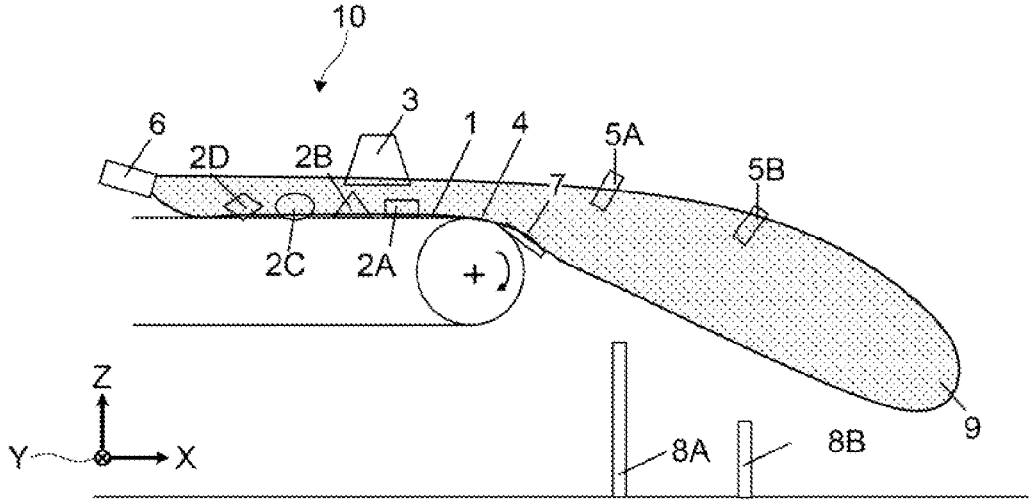
FIG. 1*b* is a side view illustrating a separation apparatus.
Figure 1C:
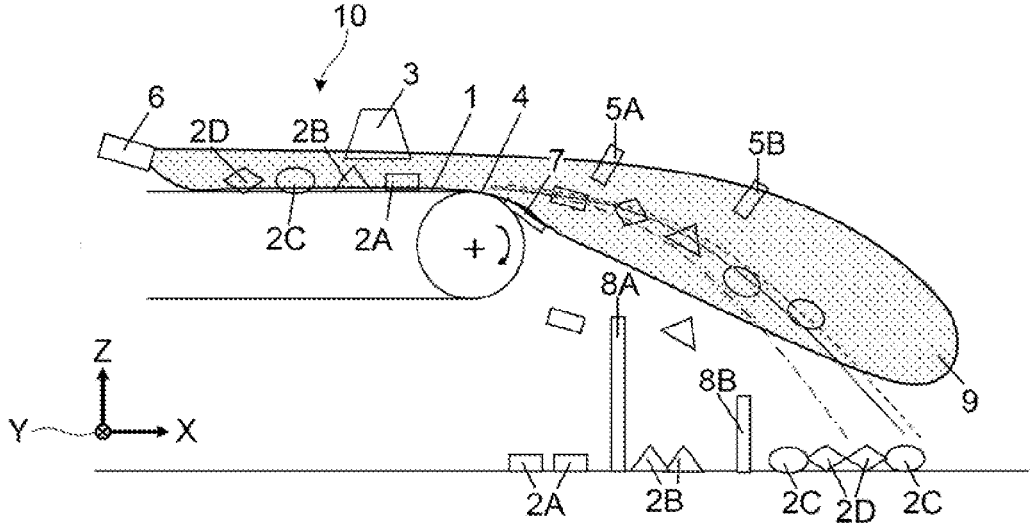
FIG. 1*c* is a side view illustrating a separation apparatus.

FIGS. 1*a* to 1*c* are side views of a separation apparatus.

Figure 2:
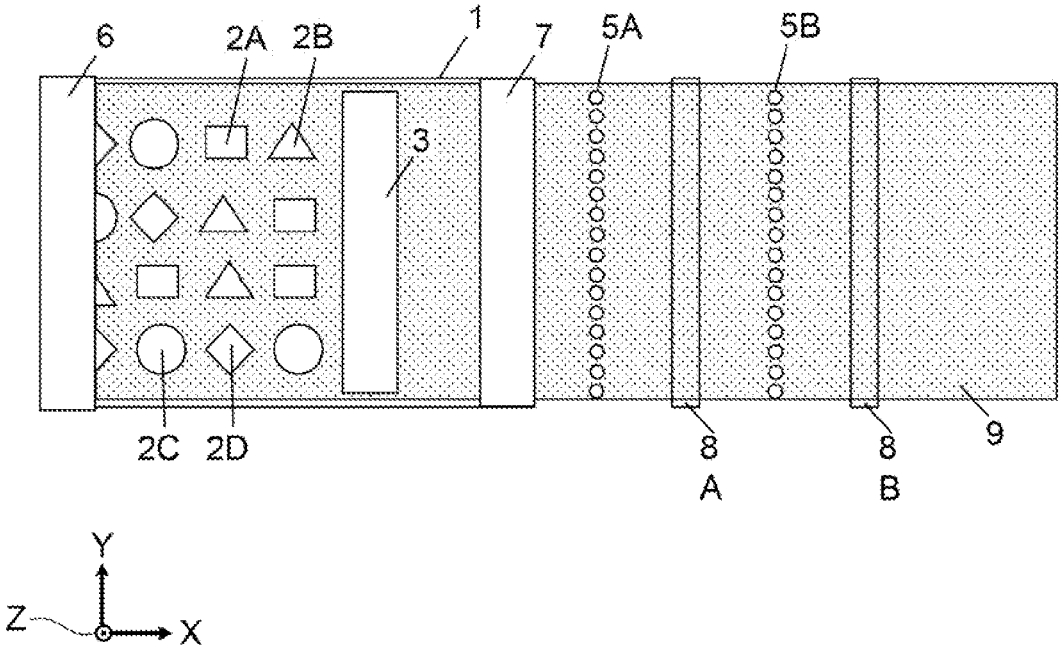
FIG. 2 is a plan view illustrating a separation apparatus.

FIG. 2 is a plan view of the separation apparatus.

As shown in these figures, a separation apparatus 10 separates first pieces 2A made of a first material and second pieces 2B made of a second material, from a group of pieces 2 that is a separation subject including the first pieces 2A and the second pieces 2B. The separation apparatus 10 includes a conveyor 1, a material distinguishing unit 3, a blower, a first separation unit, a second separation unit, and a current plate 7. The separation apparatus 10 further includes a first separation plate 8A and a second separation plate 8B.

The conveyor 1 conveys the group of pieces 2 including the pieces 2A to 2D that are placed on the conveyor 1, in one direction (in the X axis direction in the figures). For the present embodiment, a belt conveyor is used for the conveyor 1. The conveyor 1 includes the conveying end 4 at the end of the conveyor 1 to which the pieces 2A, 2B, 2C, and 2D to be separated are conveyed. The pieces 2A, 2B, 2C, and 2D which have passed the conveying end 4 are thrown into the air.

The material distinguishing unit 3 distinguishes the material of the first pieces 2A from the material of the second pieces 2B, and obtains positional information on the distinguished first pieces 2A and second pieces 2B.

The material distinguishing unit 3 may capture the images of the pieces 2A to 2D in the group of pieces 2, and analyze the obtained images to distinguish the first pieces 2A, the second pieces 2B, and other pieces 2C and 2D, based on color, shape and design. In addition, the material distinguishing unit 3 may employ a sensor with the highest sensitivity among various sensors such as a near-infrared sensor, a middle-infrared sensor, an x-ray sensor, and an image recognition sensor. For the present embodiment, a near-infrared material distinguishing unit is used and placed above the conveyor 1.

For the separation apparatus 10 according to the present embodiment, the conveyor 1 conveys, as a belt conveyor, the pieces 2A to 2D included in the group of pieces 2 in the X axis direction. The material distinguishing unit 3 can scan the sensor in the direction crossing the direction in which the belt conveyor is transferred, and obtain positional information on the material of the first pieces 2A and the material of the second pieces 2B and positional information on the materials of other pieces. Therefore, for the present embodiment, the material distinguishing unit 3 also serves as a positional information obtaining unit.

The blower generates airflow 9 that is supplied from the middle of the conveyor 1 toward the conveying end 4 (i.e. flows in the X axis direction), along the surface across which the pieces 2A to 2D (the group of pieces 2) are conveyed, i.e., along the surface of conveyor 1. It should be noted that in the figures, only a blast nozzle 6 is shown and an airflow-generating fan, a motor, a pump, and so on are omitted here.

The blast nozzle 6 of the blower for supplying the airflow 9 is a slit nozzle head having an opening with a slit shape that is provided in the width direction of the conveyor 1 (Y axis direction). The blast nozzle 6 is provided above the conveyor 1 and has an opening shape that allows the airflow 9 to be supplied to an area larger than or equivalent to an area covering the effective width of the conveyor 1. Here, the effective width is in the Y axis direction and is a maximum width over which the group of pieces 2 can be conveyed.

Based on the positional information on the first pieces 2A and the second pieces 2B that is obtained by the material distinguishing unit 3, the first separation unit and the second separation unit (hereinafter referred to also as "separation apparatus") (i) generates airflow in a pulse-like manner, and (ii) blows off the first pieces 2A and the second pieces 2B that have been thrown forward from the conveying end 4 of the conveyor 1 to change a drop path. For the present embodiment, the first separation unit includes a first group of nozzles 5A having nozzles arrayed in one column and connected to a pneumatic supply. The second separation unit includes a second group of nozzles 5B having nozzles arrayed in one column and connected to a pneumatic supply.

The first separation unit blows off the first pieces 2A by the airflow discharged in the pulse-like manner from a specific nozzle selected from the first group of nozzles 5A. The second separation unit blows off the second pieces 2B towards a place different from a place towards which the first pieces 2A is blown off, by the airflow discharged in the pulse-like manner from a specific nozzle selected from the first group of nozzles 5B.

The current plate 7 is a plate that protrudes from the conveyor 1 in the direction in which the pieces 2A, 2B, 2C, and 2D (group of pieces 2) are thrown forward from the conveying end 4, and that is provided below the trajectories of the pieces 2A, 2B, 2C, and 2D that have been thrown forward. For the present embodiment, (i) the current plate 7 is provided below and along the trajectories of the pieces 2A, 2B, 2C, and 2D to be separated, (ii) the starting end of the current plate 7 is beside the surface of the conveyor and the current plate 7 protrudes from the conveyor 1 along the conveying surface and (iii) the upper surface of the current plate 7 is below the trajectories of the pieces 2A, 2B, 2C, and 2D to be separated.

The current plate 7 is a plate that controls the airflow 9 near the trajectories of the pieces 2A, 2B, 2C, and 2D to be separated and that adjusts the airflow 9 discharged from the blast nozzle 6 of the blower and leaving the conveyor 1 to obtain the desired trajectories of the pieces 2A, 2B, 2C, and 2D (group of pieces 2).

The first separation plate 8A and the second separation plate 8B (hereinafter referred to also as "separation plate") respectively separate and recover the pieces 2A and pieces 2B of specific materials that have been separated from the trajectories of the pieces 2A, 2B, 2C, and 2D (group of pieces 2) to be separated. For the present embodiment, the separation plates 8A and 8B are provided below the trajectories of the pieces 2A, 2B, 2C, and 2D (group of pieces 2). The separation plates 8A and 8B are plates that extend in the horizontal direction (Z axis direction) and that have a width greater than or equivalent to the width of the conveyor 1 (in the Y axis direction). The first separation plate 8A and the second separation plate 8B are provided in parallel and in the conveying direction of the conveyor 1 (X axis direction). The first separation plate 8A is provided closer to the conveyor 1 than the second separation plate 8B. The first separation plate 8A is taller than the second separation plate 8B. The height of the first separation plate 8A and the height of the second separation plate 8B correspond to the trajectories of the pieces 2A, 2B, 2C, and 2D (the group of pieces 2).

It should be noted that the present invention is not limited to the above embodiment. For example, as an embodiment of the present invention, another embodiment may be achieved by optionally combining structural elements described in the present description or removing the structural elements. Moreover, the present invention includes modifications obtained by making various modifications that those skilled in the art would conceive to the above embodiment without departing from the scope of the present invention, that is, the meaning of the claim wording.

For example, the material distinguishing unit 3 includes sensors provided in an array or in a matrix, and distinguishes between the first pieces 2A and the second pieces 2B at different positions on the conveyor at one time.

Moreover, the blower may include a nozzle movable to a given position and move the nozzle or may change the direction of a nozzle, based on positional information.

Moreover, the separation plates 8A and 8B may have any shape as far as the first pieces 2A and the second pieces 2B cannot pass through. For example, the separation plates 8A and 8B may have many holes, may be mesh plates, or may be grid plates.

The following describes a separation method.

FIGS. 1*a* to 1*c* show a process for separating the pieces 2A and the pieces 2B of any specific materials, from the pieces 2A, 2B, 2C, and 2D (the group of pieces 2) that are separation subjects conveyed by the conveyor 1.

In the process shown in FIG. 1*a*, the conveyor 1 conveys the pieces 2A, 2B, 2C, and 2D to be separated, in the conveying direction (X axis direction). Here, the first pieces 2A and the second pieces 2B are any specific materials, respectively.

In the process shown in FIG. 1*b*, the materials and locations of the pieces 2A, 2B, 2C, and 2D (the group of pieces 2) to be separated are, for example, distinguished when the group of pieces 2 are passing under the material distinguishing unit 3. Moreover, the blast nozzle 6 successively supplies the airflow 9 in the direction in which the conveyor 1 is transferred, along the upper surface of the conveyor 1. Here, the airflow 9 is supplied to an area larger than or equivalent to an area covering the effective width of the conveyor 1. The effective width is a width which allows the group of pieces 2 to be conveyed. In other words, the airflow 9 is steadily supplied in each process in FIGS. 1*a* to 1*c*.

In the process shown in FIG. 1*c*, the pieces 2A, 2B, 2C, and 2D that are separation subjects and have been distinguished by the material distinguishing unit 3 are being thrown forward from the conveying end 4 of the conveyor 1. Being carried by the airflow 9, the pieces 2A, 2B, 2C, and 2D (group of pieces 2) travel a predetermined trajectory.

Here, when the first pieces 2A of any specific material is passing under the first group of nozzles 5A, air is discharged in the pulse-like manner only from a nozzle of the first group of nozzles 5A, corresponding to the pieces 2A, and the first pieces 2A of any specific material is blown off to separate the first pieces 2A from the trajectories of the pieces 2A, 2B, 2C, and 2D (group of pieces 2). For the present embodiment, the direction in which first pieces 2A is blown off is a direction that crosses the trajectory of the first pieces 2A, more specifically, a direction that is perpendicular to the tangential line of the trajectory, and a direction that the first pieces 2A can clear the first separation plate 8A.

The pieces 2A, 2B, 2C, and 2D (group of pieces 2) continue to travel the trajectory. When the second pieces 2B of any specific material pass under the second group of nozzles 5B, air is discharged in the pulse-like manner only from a nozzle of the first group of nozzles 5B, corresponding to the pieces 2B, and the first pieces 2B are blown off to separate the first pieces 2B from the trajectories of the pieces 2B, 2C, and 2D (group of pieces 2). For the present embodiment, a direction in which the first pieces 2B is blown off is a direction that crosses the trajectory of the first pieces 2B, more specifically, a direction that is perpendicular to the tangential line of the trajectory, and a direction that the first pieces 2B can clear the first separation plate 8B.

It should be noted that the representative trajectories of the pieces 2A, 2B, 2C, and 2D to be separated are represented by a solid line, a broken line, and a dashed-dotted line.

For example, when the pieces 2A, 2B, 2C, and 2D are sheet-like forms, and have a thin thickness and a large area, the pieces 2A, 2B, 2C, and 2D may ascend by lift force during travel after being thrown forward from the conveying end 4. Moreover, when the pieces 2A, 2B, 2C, and 2D are flat plates, and when an elevation angle is generated during travel, i.e., the front is in a position higher than the rear, lift force may also affect the pieces 2A, 2B, 2C, and 2D. The airflow 9 which is steadily supplied from the blast nozzle 6 by the blower can control the ascension of the pieces 2A, 2B, 2C, and 2D, and reduces variation in the trajectories of the pieces 2A, 2B, 2C, and 2D. In other words, supplying the airflow 9 from behind the pieces 2A, 2B, 2C, and 2D in a sheet-like form or in a flat plate-like form allows (i) the control of the ascension of the pieces 2A, 2B, 2C, and 2D and (ii) the reduction of variation in upward trajectories.

Moreover, when the pieces 2A, 2B, 2C, and 2D are materials with a small apparent specific gravity such as urethane foam, travelling speed may slow down due to the air resistance. The air resistance is reduced by the airflow 9 that is steadily supplied from the blast nozzle 6 of the blower. Therefore, these pieces 2A, 2B, 2C, and 2D with a small specific gravity are guided along the airflow 9. In other words, supplying the airflow 9 from behind the travelling pieces 2A, 2B, 2C, and 2D gives the pieces 2A, 2B, 2C, and 2D thrust, and alleviates the slowdown due to the air resistance. This reduces variation in downward trajectories of the pieces 2A, 2B, 2C, and 2D.

Moreover, the current plate 7 controls air current (turbulence) that generates along the head surface of the conveyor 1 due to the running and rotation of the conveyor 1, and adjusts the airflow 9 to flow along the trajectories of the pieces 2A, 2B, 2C, and 2D. This reduces possibilities that the pieces 2A, 2B, 2C, and 2D are off the trajectories and suddenly drop, due to the airflow 9 flowing along the head surface of the conveyor 1.

Thus, the present invention can reduce variation in trajectories due to the difference in shape or specific gravity of the pieces 2A, 2B, 2C, and 2D to be separated. Therefore, in the trajectories of the pieces 2A, 2B, 2C, and 2D, the first pieces 2A of any specific material can be appropriately blown off by the air, and in the trajectories ahead from here, the second pieces 2B can be appropriately blown off. Therefore, in a series of travels of the pieces 2A, 2B, 2C, and 2D, pieces of two kinds of materials can be separated with a high degree of accuracy.

It should be noted that FIGS. 1*a* to 1*c* and FIG. 2 show the embodiment that when the pulse air is discharged downward from the first group of nozzles 5A and the second group of nozzles 5B that are located above the trajectories of the pieces 2A, 2B, 2C, and 2D to be separated, the first pieces 2A and the second pieces 2B are blown downward to be separated. However, the locations of the first group of nozzles 5A and the second group of nozzles 5B do not have to be based on the information of the trajectories of the pieces 2A, 2B, 2C, and 2D. For example, pieces of a specific material may be blown upward to be separated, by providing the first group of nozzles 5A and the second group of nozzles 5B below the trajectories and discharging the air upward in the pulse-like manner. Moreover, the first group of nozzles 5A may be provided above the trajectories and the second group of nozzles 5B may be provided below the trajectory, or vice versa.

Moreover, in addition to the first group of nozzles 5A and the second group of nozzles 5B, another group or other groups of nozzles may be provided above or below the trajectory in order to separate three or more kinds of materials.

The following describes a detailed embodiment of the present invention.

Figure 3A:
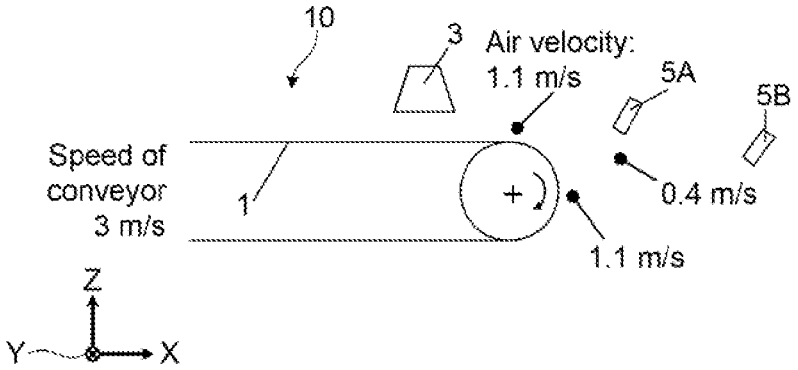
FIG. 3a Related Art
FIG. 3*a* is a side view illustrating a separation apparatus.
Figure 3B:
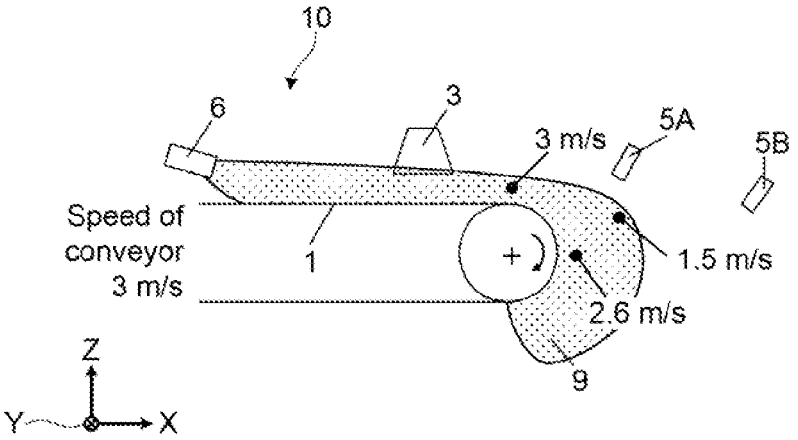
FIG. 3b Related Art
FIG. 3*b* is a side view illustrating a separation apparatus and a distribution of airflow near the conveying end of a conveyor.
Figure 3C:
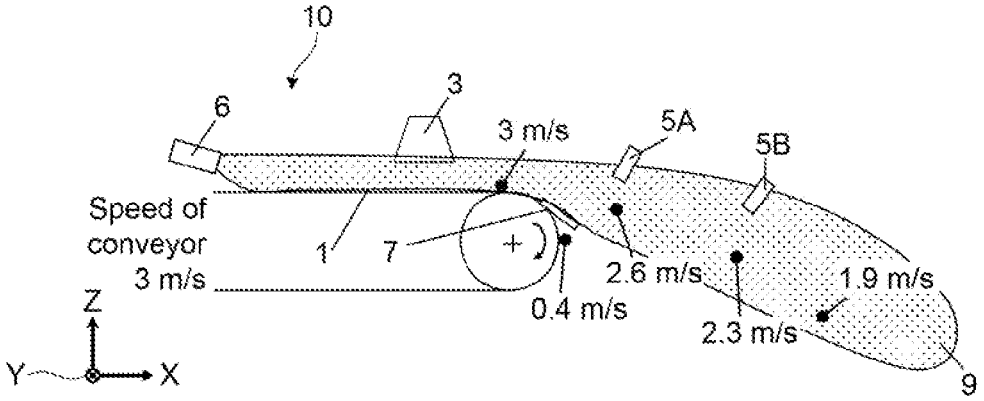
FIG. 3*c* is a side view illustrating a separation apparatus and a distribution of airflow near the conveying end of a conveyor.

FIGS. 3*a* to 3*c* illustrate the generation of airflow near the conveyor 1 and the trajectories of the pieces 2A, 2B, 2C, and 2D in the process for separating the pieces in the group of pieces 2.

In FIG. 3*a*, the blower is not discharging the airflow 9 from the blast nozzle 6. FIG. 3*a* illustrates the generation of airflow near the conveyor 1 running at 3 meters per second and the trajectory of the group of pieces 2. When the conveyor 1 runs at 3 meters per second, airflow with a speed of 1.1 meters per second generates on the surface of the conveyor 1.

FIG. 3*b* illustrates a situation where the blower is discharging the airflow 9 from the blast nozzle 6, and the current plate 7 is not provided. The blower supplies the airflow 9 from the blast nozzle 6 in the direction in which the conveyor 1 is transferred, along the conveying surface of the conveyor. The airflow 9 is successively supplied to an area that is larger than or equivalent to an area covering the effective width of the conveyor 1. When the airflow 9 is supplied from the blast nozzle 6 so that air velocity at the conveying end 4 of the conveyor 1 is 3 meters per second, airflow with a speed of 1.5 meters per second generates near the trajectories of pieces that are separation subjects and are flying vertically downward from the first group of nozzles 5A. Thus, the airflow 9 from the blast nozzle 6 can control variation in upward trajectories due to lift power and variation in downward trajectories due to drag force.

Moreover, when the airflow 9 is supplied from the blast nozzle 6, there is an increase in the amount of airflow along the head surface of the conveyor 1. Therefore, in the situation shown in FIG. 3*b*, the pieces 2A, 2B, 2C, and 2D to be separated drop suddenly.

FIG. 3*c* illustrates a situation where the blower is discharging the airflow 9 from the blast nozzle 6, and the current plate 7 is provided. Providing the current plate 7 dams and adjusts the airflow along the head surface of the conveyor 1, and directs the airflow in the traveling direction of the pieces 2A, 2B, 2C, and 2D to be separated. The airflow 9 with a speed of 2.6 meters per second is seen near the trajectories of pieces that are separation subjects and are flying vertically downward from the first group of nozzles 5A. Moreover, the airflow 9 with a speed of 2.3 meters per second is seen near the trajectory of the group of pieces 2 flying vertically downward from the first group of nozzles 5B.

Thus, the airflow 9 supplied from the blast nozzle 6 of the blower and the current plate 7 can reduce variation in the trajectories of the pieces 2A, 2B, 2C, and 2D (group of pieces 2) to be separated.

The following describes further details of the embodiment of the present invention.

Refrigerators from which a compressor and chlorofluorocarbons in an insulating material have been removed are crushed into pieces by a crusher and recovered by separation using a net having a mesh size of 5 to 150 mm as the group of pieces 2.

Pieces of 1 kg are spread on the conveyor 1 so that pieces are not overlapped each other. The variation in the trajectories of pieces of 1 kg is measured using a high speed camera and the effects of the airflow 9 from the blast nozzle 6 and the current plate 7 are checked.

The current plate 7 is provided along the trajectory of the group of pieces 2 to be separated. In addition, the starting end of the current plate 7 is immediately beside the conveying surface and the current plate 7 protrudes from the conveyor 1 along the conveying surface, and the upper surface of the current plate 7 is below the trajectory of the group of pieces 2.

To evaluate the variation in the trajectories, the trajectories of the pieces included in the group of pieces 2 are measured based on playback video of a high speed camera, and the distances between the trajectories of the pieces in the group of pieces 2 at the point 400 mm away from the conveying end 4 of the conveyor 1 in the conveying direction are measured.

Figure 4:
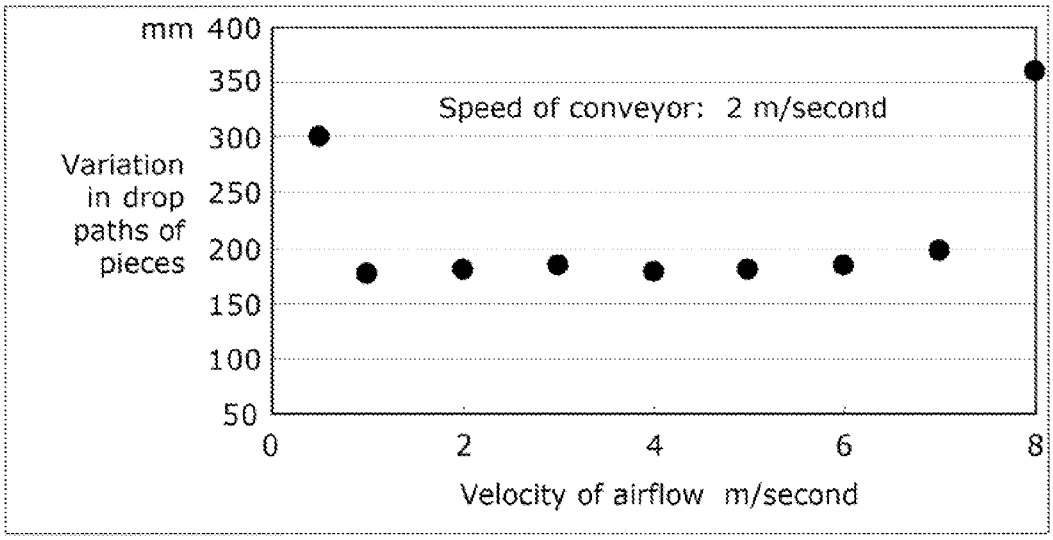
FIG. 4 illustrates the velocity of airflow and variation in the trajectories of pieces to be separated.
Figure 5:
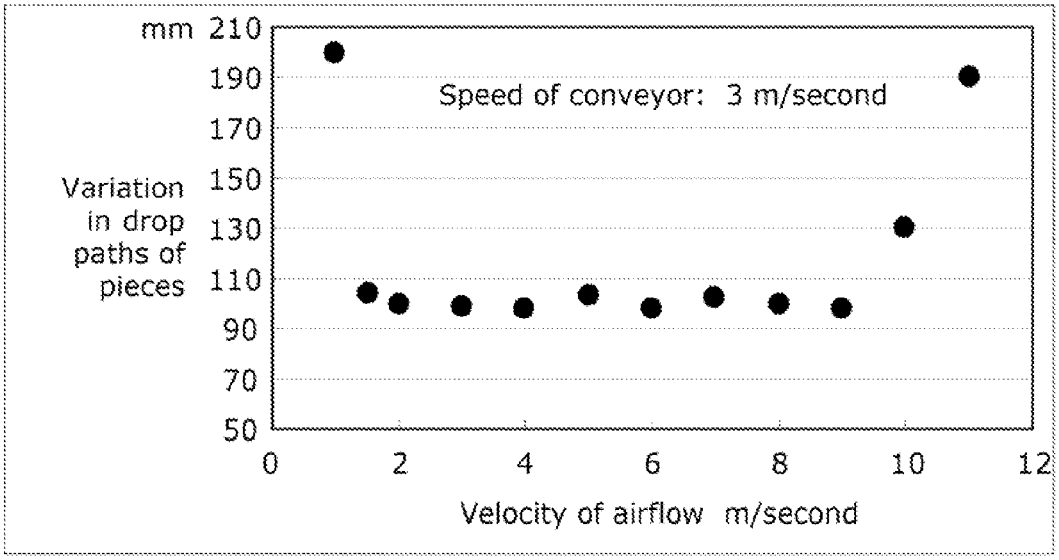
FIG. 5 illustrates a relationship between the velocity of airflow at the speed of a conveyor different from the speed of a conveyor shown in FIG. 4 and variation in the trajectories of pieces to be separated.

FIGS. 4 and 5 are results obtained by examining the effects of the velocity of the airflow 9 at the conveying end 4 of the conveyor 1. The conveyor 1 is operated with conditions: a head-pulley radius of 170 mm and a conveying speed of 2 m per second or 3 m per second. The current plate 7 is an acrylic plate having a thickness of 3 mm and a length of 250 mm (and a width same as the effective width of the conveyor 1).

FIG. 4 illustrates the effects of air velocity that affect variation in the trajectories of pieces in the group of pieces 2 when the conveying speed of the conveyor is 2 m per second in FIG. 4 and 3 m per second in FIG. 5. It has been found that there is an optimal air velocity area both for the conveying speed of conveyor of 2 m per second and the conveying speed of 3 m per second. It has been also found that good results are obtained both for the conveying speed of conveyor of 2 m per second and the conveying speed of 3 m per second when the velocity of the airflow 9 ranges from ½ to 3 times the conveying speed of the conveyor. The reason can be assumed that when the velocity of the airflow 9 is too small for the conveying speed, the attenuation of the speed of a material with a small apparent specific gravity cannot be controlled. It can be also assumed that when the velocity of the airflow 9 is too large for the conveying speed, turbulence occurs and the trajectories of pieces in the group of pieces 2 are disturbed.

Moreover, as a result of examining the effect of the width of the height direction (Z axis direction) of the airflow 9, it has been found that when the height of the airflow 9 is smaller than the height of the group of pieces 2, the attenuation of the speed of a material with a small apparent specific gravity cannot be controlled and some of the pieces in the group of pieces 2 ascend, thus rendering the trajectories erratic. Therefore, preferably, the width of the height direction (i.e., the height) of the airflow 9 should be greater than the height of the group of pieces 2 (average height of the pieces).

The following describes the results obtained by examining the relationship between the position of the terminal end of the current plate 7 and the airflow 9 flowing along the head surface of the conveyor 1.

It should be noted that an acrylic plate having a thickness of 2 mm is used for the current plate 7. Moreover, the current plate 7 is provided so that (i) the current plate 7 is parallel with the trajectory of the group of pieces 2 thrown forward from the conveyor 1, (ii) the lower portion of the starting end of the current plate 7 is beside the conveyor 1, and (iii) the position of the upper portion of the starting end is 5 mm below the conveying surface of the conveyor 1.

Figure 6:
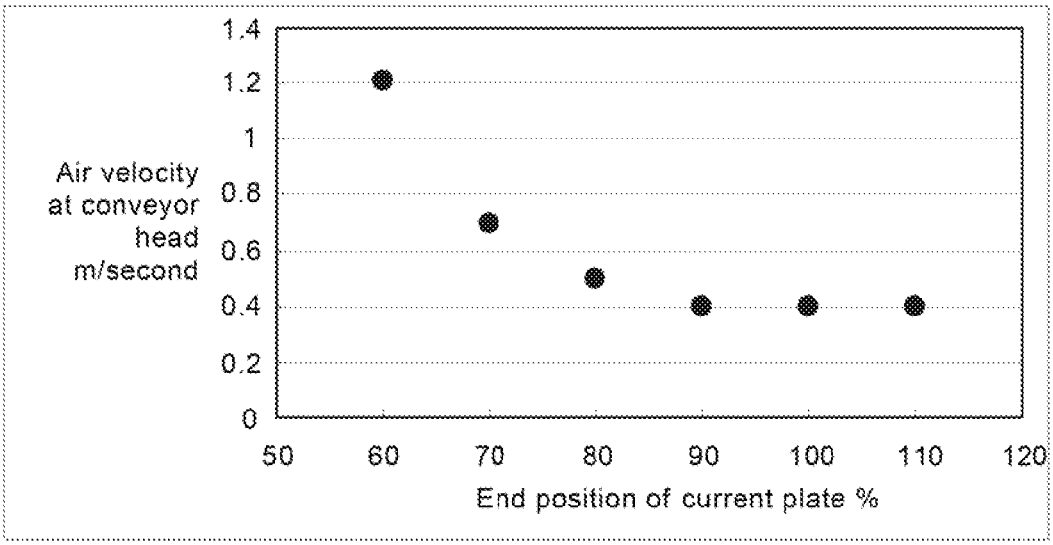
FIG. 6 illustrates a relationship between the position of the terminal end of a current plate and airflow flowing along the curve of a head pulley.
Figure 6:
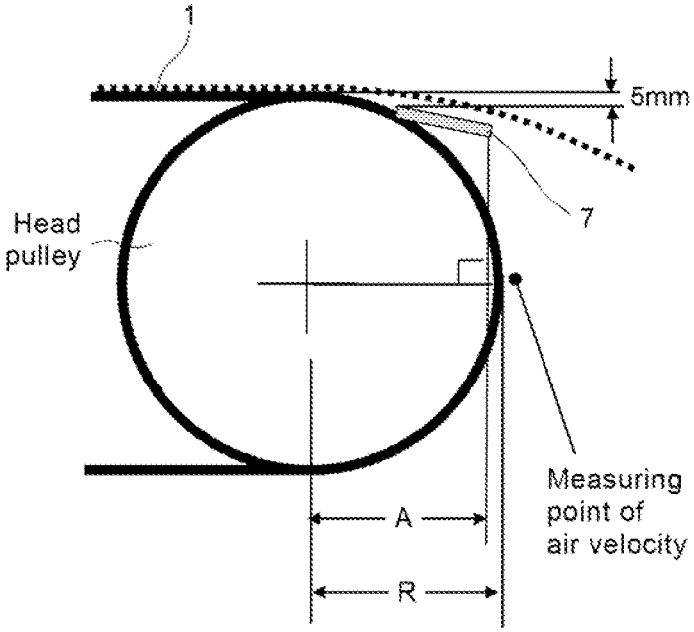
Figure 7A:
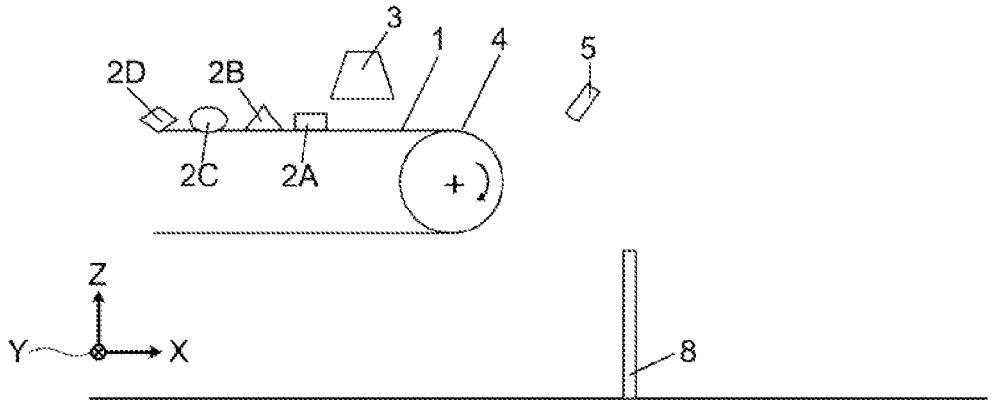
FIG. 7a Related Art
FIG. 7*a* is a side view illustrating a conventional separation apparatus.
Figure 7B:
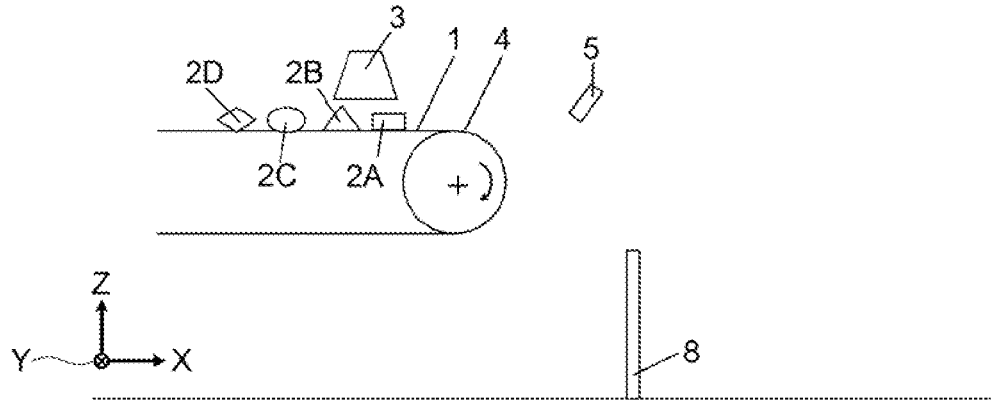
FIG. 7b Related Art
FIG. 7*b* is a side view illustrating a conventional separation apparatus.
Figure 7C:
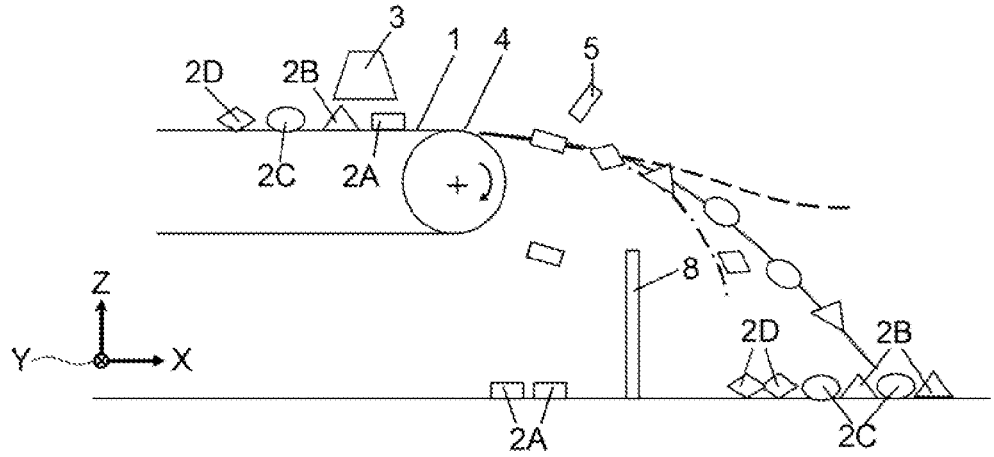
FIG. 7c Related Art
FIG. 7*c* is a side view illustrating a conventional separation apparatus.
Figure 8:
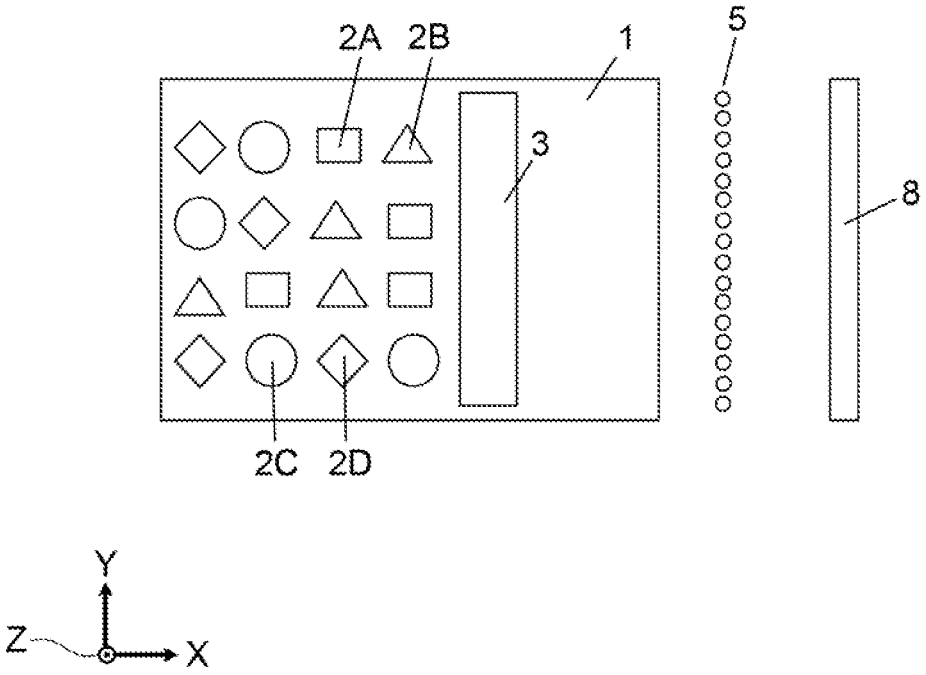
FIG. 8 Related Art
FIG. 8 is a plan view illustrating a conventional separation apparatus.
Figure 9A:
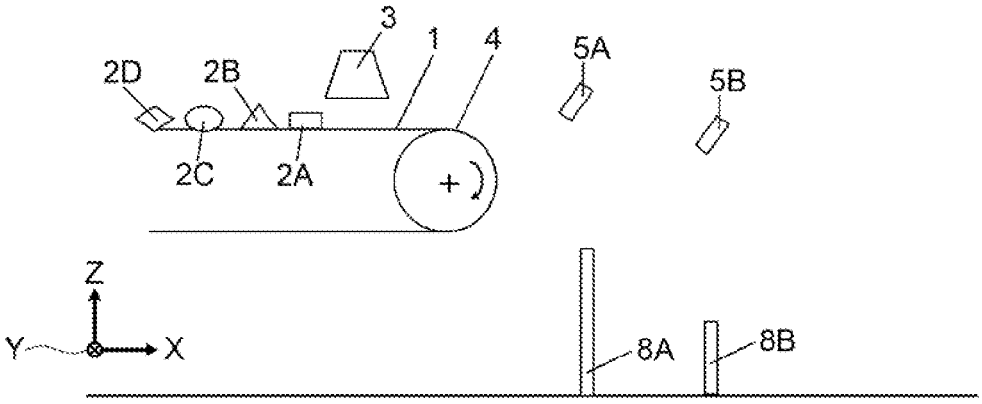
FIG. 9a Related Art
FIG. 9*a* is a side view illustrating a conventional separation apparatus.
Figure 9B:
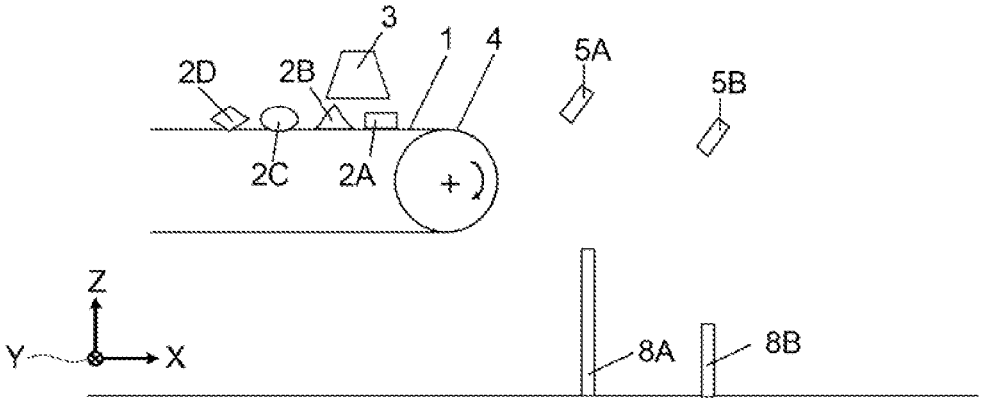
FIG. 9b Related Art
FIG. 9*b* is a side view illustrating a conventional separation apparatus.
Figure 9C:
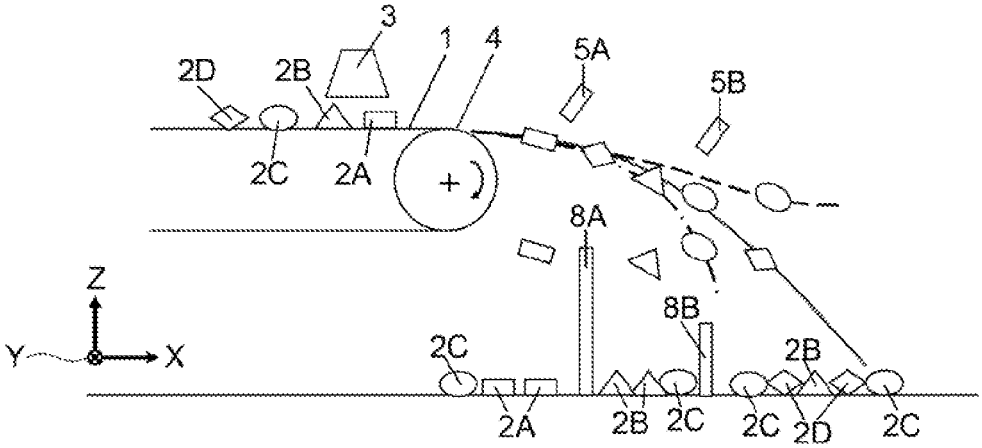
FIG. 9c Related Art
FIG. 9*c* is a side view illustrating a conventional separation apparatus.

FIG. 6 illustrates the relationship between the position of the terminal end of the current plate 7 and the air velocity at the head of the conveyor 1 (measuring point of the speed of airflow). The position of the terminal end of the current plate 7 is changed by changing the length of the current plate 7, and the airflow 9 flowing along the curve of the head of the conveyor 1 is measured. It should be noted that the conveyor 1 has a head-pulley radius of 170 mm and a running speed of 3 m per second. In FIG. 6, the horizontal axis denotes the position of the terminal end of the current plate 7, and the vertical axis denotes the air velocity at the conveyor head. It should be noted that the position of the terminal end of the current plate 7 is defined as follows. The intersection in the horizontal plane between the vertical axis passing through the terminal end of the current plate 7 and the rotation axis passing through the center of the head pulley is determined, and the distance between the intersection and the center of the head pulley (i.e., the distance between the rotation axis of the head pulley and the vertical axis) is determined. The position of the terminal end of the current plate 7 is given a value expressed by the percentage of the proportion of the distance between the rotation axis of the head pulley and the vertical axis to the radius of the head pulley.

It has been found from FIG. 6 that when a value indicating the position of the terminal end of the current plate 7 is smaller than 80% of the head pulley radius, the airflow 9 flows along the curve of the head of the conveyor 1.

Moreover, a similar test was conducted for a conveyor having a head-pulley radius of 75 mm. As same as the conveyor having a head-pulley radius of 170 mm, it has been found that when the value indicating the position of the terminal end of the current plate 7 is smaller than 80% of the radius of the head pulley, the air flow 9 flows along the curve of the head of the conveyor 1. Therefore, preferably, the value indicating the position of the terminal end of the current plate 7 should have 80% or greater than the radius of the head pulley.

The pieces of the group of pieces 2 are spread in order on the conveyor 1 without being overlapped each other, and the variation in the trajectories of pieces in the group of pieces 2 are captured by a high speed camera. The current plate 7 having the starting end beside the conveying surface of the conveyor is provided along and below the trajectory of the group of pieces 2. The current plate 7 is an acrylic plate having a thickness of 3 mm and a length of 200 mm.

FIG. 10 illustrates recovery yield when pieces made of PP and pieces made of ABS are separated from the group of pieces 2 during a series of travels. It should be noted that the pieces made of PP and the pieces made of ABS are blown off by the first group of nozzles 5A and the second group of nozzles 5B, respectively. Moreover, results obtained by the conventional separation method are also recited for comparison purposes. It should be noted that recovery yield is calculated by the following expression. Recovery yield (%)= (weight of recovered predetermined resin/weight of predetermined resin in the group of pieces 2 before separation)×100

A higher recovery yield can be obtained both for the pieces made of PP and the pieces made of ABS, by using the above separation apparatus and performing the above separation method. As to the pieces made of ABS separated by the second group of nozzles 5B that is more distant from the conveyor 1 than the first group of nozzles 5A, the recovery yield is significantly higher than that of the conventional separation method.

The present invention can improve the recovery yield of pieces of any specific materials when pieces of two kinds of materials are independently separated in a series of travels. Moreover, the present invention can be also applied to the recycling of resources as a separation apparatus and a separation method for recycling pieces of specific materials contained in discarded home appliances and domestic wastes.

REFERENCE SIGNS LIST

1 conveyor
2 group of pieces
2A first pieces
2B second pieces
3 material distinguishing unit
4 conveying end
5 group of nozzles
5A first group of nozzles
5B second group of nozzles
6 blast nozzle
7 current plate
8A first separation plate
8B second separation plate
9 airflow
10 separation apparatus

The invention claimed is:

1. A separation apparatus for separating first pieces and second pieces from a group of pieces that are separation subjects including the first pieces and the second pieces, the separation apparatus comprising:

a conveyor that conveys, in a conveying direction toward a conveying end, the group of pieces placed on the conveyor;

a material distinguisher that distinguishes, between the first pieces and the second pieces that are placed on the conveyor;

a blower that generates an airflow in the conveying direction toward the conveying end of the conveyor and along a surface on which the group of pieces is conveyed;

a first separator that discharges airflow to blow off the first pieces, from the group of pieces carried by the airflow generated by the blower from the conveying end of the conveyor, based on a differentiation result obtained by the material distinguisher;

a second separator that discharges airflow to blow off the second pieces from the group of pieces carried by the airflow generated by the blower from the conveying end based on the differentiation result; and a current plate provided at the conveying end of the conveyor to be below trajectories of the group of pieces thrown forward, the current plate protruding from the conveyor; and a pulley located at the conveying end of the conveyor, the current plate having a starting end and a terminal end located above a bottom of the pulley.

2. The separation apparatus according to claim 1, wherein a velocity of the airflow generated by the blower ranges from ½ to 3 times a conveying speed of the group of pieces placed on the conveyor.

3. The separation apparatus according to claim 1, wherein a vertical thickness of the airflow generated by the blower is greater than an average height of the pieces in the group of pieces.

4. The separation apparatus according to claim 1, wherein the current plate is provided so that a distance between a vertical line passing through a terminal end of the current plate and a rotation axis of the pulley is i) longer than or equal to a length of 80% of a radius of the pulley, and ii) shorter than the radius of the pulley.

5. A separation method for separating first pieces made of a first material and second pieces made of a second material, from a group of pieces that is a separation subject including the first pieces and the second pieces, the separation method comprising:

conveying, by a conveyor, the group of pieces in one direction;

distinguishing between the first pieces and the second pieces that are placed on the conveyor, according to material, by a material distinguisher;

generating, by a blower, airflow supplied from a middle of the conveyor toward a conveying end along a surface on which the group of pieces is conveyed;

discharging airflow to blow off, by a first separator, the first pieces, from the group of pieces carried by the airflow from the conveying end that is an end of the conveyor, based on a differentiation result obtained by the material distinguisher;

discharging airflow to blow off, by a second separator, the second pieces toward a place different from a place toward which the first separator blows off the first pieces, based on the differentiation result, the second pieces being blown off from the group of pieces carried by the airflow from the conveying end that is the end of the conveyor; and adjusting the airflow by a current plate provided below trajectories of the group of pieces thrown forward, the current plate protruding from the conveyor in a direction in which the group of pieces are thrown forward such that the current plate does not touch the group of pieces.

6. The separation method according to claim 5, wherein a velocity of the airflow at the conveying end of the conveyor ranges from ½ to 3 times a conveying speed of the group of pieces placed on the conveyer.

7. The separation method according to claim 5, wherein a vertical thickness of the airflow is greater than heights of pieces that are separation subjects and are conveyed by the conveyor.

8. The separation method according to claim 5, wherein the conveyor includes a pulley at the conveying end of the conveyor, and the current plate is provided so that a distance between a vertical line passing through a terminal end of the current plate and a rotation axis of the pulley is longer than or equal to a length of 80% of a radius of the pulley.

* * * * *